US007681856B1

(12) United States Patent
Thomas et al.

(10) Patent No.: US 7,681,856 B1
(45) Date of Patent: Mar. 23, 2010

(54) DOCUMENT HOLDER

(75) Inventors: Emmanuel Thomas, 174 Springdale Ave., East Orange, NJ (US) 07017-4818; Herrys Angerville, East Orange, NJ (US)

(73) Assignee: Emmanuel Thomas, Pomona, NY (US)

( * ) Notice: Subject to any disclaimer, the term of this patent is extended or adjusted under 35 U.S.C. 154(b) by 0 days.

(21) Appl. No.: 11/566,784

(22) Filed: Dec. 5, 2006

(51) Int. Cl.
*B41J 11/02* (2006.01)

(52) U.S. Cl. ..... 248/442.2; 248/447; 248/454; 248/918

(58) Field of Classification Search ..... 248/442.2, 248/447, 454
See application file for complete search history.

(56) References Cited

U.S. PATENT DOCUMENTS

| | | | | | |
|---|---|---|---|---|---|
| 4,902,078 | A | | 2/1990 | Judd | |
| 4,960,257 | A | * | 10/1990 | Waters | 248/442.2 |
| 5,074,512 | A | * | 12/1991 | Gianforcaro et al. | 248/442.2 |
| 5,082,235 | A | * | 1/1992 | Crowther et al. | 248/231.41 |
| D327,501 | S | | 6/1992 | Maloney | |
| 5,292,099 | A | * | 3/1994 | Isham et al. | 248/442.2 |
| D364,427 | S | * | 11/1995 | Kirchhoff et al. | D19/88 |
| 5,499,793 | A | * | 3/1996 | Salansky | 248/442.2 |
| 5,618,020 | A | | 4/1997 | Hegarty et al. | |
| 5,620,162 | A | * | 4/1997 | Beckwith et al. | 248/442.2 |
| 5,881,986 | A | | 3/1999 | Hegarty | |
| 5,931,437 | A | * | 8/1999 | Neuhof et al. | 248/442.2 |
| 5,975,478 | A | * | 11/1999 | Marino | 248/442.2 |
| 5,988,571 | A | * | 11/1999 | Ward et al. | 248/176.1 |
| 6,024,337 | A | | 2/2000 | Correa | |
| 6,173,936 | B1 | | 1/2001 | Hegarty | |
| 6,290,200 | B1 | * | 9/2001 | Ko | 248/442.2 |
| 6,550,737 | B1 | * | 4/2003 | Sai et al. | 248/311.2 |

OTHER PUBLICATIONS

3M DH440 Document Holder from http://www.compusa.com/products/product_info.asp?product_code=50046095 &Pn=Document_Holder.

* cited by examiner

*Primary Examiner*—J. Allen Shriver, II
*Assistant Examiner*—Alaeddin Mohseni
(74) *Attorney, Agent, or Firm*—Emmanuel Thomas

(57) ABSTRACT

This patent discloses a document holder for a computer monitor. The document holder may include a panel. Attached to the panel may be a bottom extension, a top extension, a left side extension, fasteners having a top arm and a bottom, and a panel movement mechanism configured to permit a user to pitch the panel back and forth and to move the panel up and down. The bottom extension, the top extension, and the left side extension may be moved in and out of slots and positioned to accommodate larger or smaller articles. The fasteners may secure the document holder to the computer monitor.

13 Claims, 3 Drawing Sheets

DOCUMENT HOLDER

BACKGROUND

1. Field of Endeavor

The information disclosed in this patent relates a moveable support to hold material in position to be viewed during use of a computer and other transcription devices.

2. Background Information

Personal computers have become essential to society. Just about everyone has one and uses one. Its been said that without personal computers, our present society would exist in a completely different form.

In its most basic form, personal computers coordinate an exchange of information. Information from the user, information from many documents the user may be reading, and information from the Internet and other computers all may be entered into a personal computer, processed, and sent out of that computer. The documents the user may be reading typically are scattered around the desk supporting the computer in a clutter whose organization is known only to the user.

When most people tire of having their papers scattered around their desk and of the neck and back pain that comes from straining to read them, they may purchase a document holder. Document holders are accessories to computer monitors that help keep the documents positioned properly while a user is working from them. Holding the documents in a proper position helps the user to avoid neck and back pain and save space on that user's desk.

Some document holders rest on a desk, but a problem with these is that they may take up needed desk space. These document holders typically hold a single sheet of paper. A problem with these single sheet document holders is that they require you to change documents twice as frequently since they are unable to hold two papers side-by-side.

What is needed is a device to overcome these and other needs.

SUMMARY

This patent discloses a document holder for a computer monitor. The document holder may include a panel. Attached to the panel may be a bottom extension, a top extension, a left side extension, fasteners having a top arm and a bottom, and a panel movement mechanism configured to permit a user to pitch the panel back and forth and to move the panel up and down. The bottom extension, the top extension, and the left side extension may be moved in and out of slots and positioned to accommodate larger or smaller articles. The fasteners may secure the document holder to the computer monitor.

DETAILED DESCRIPTION

Figure 1:
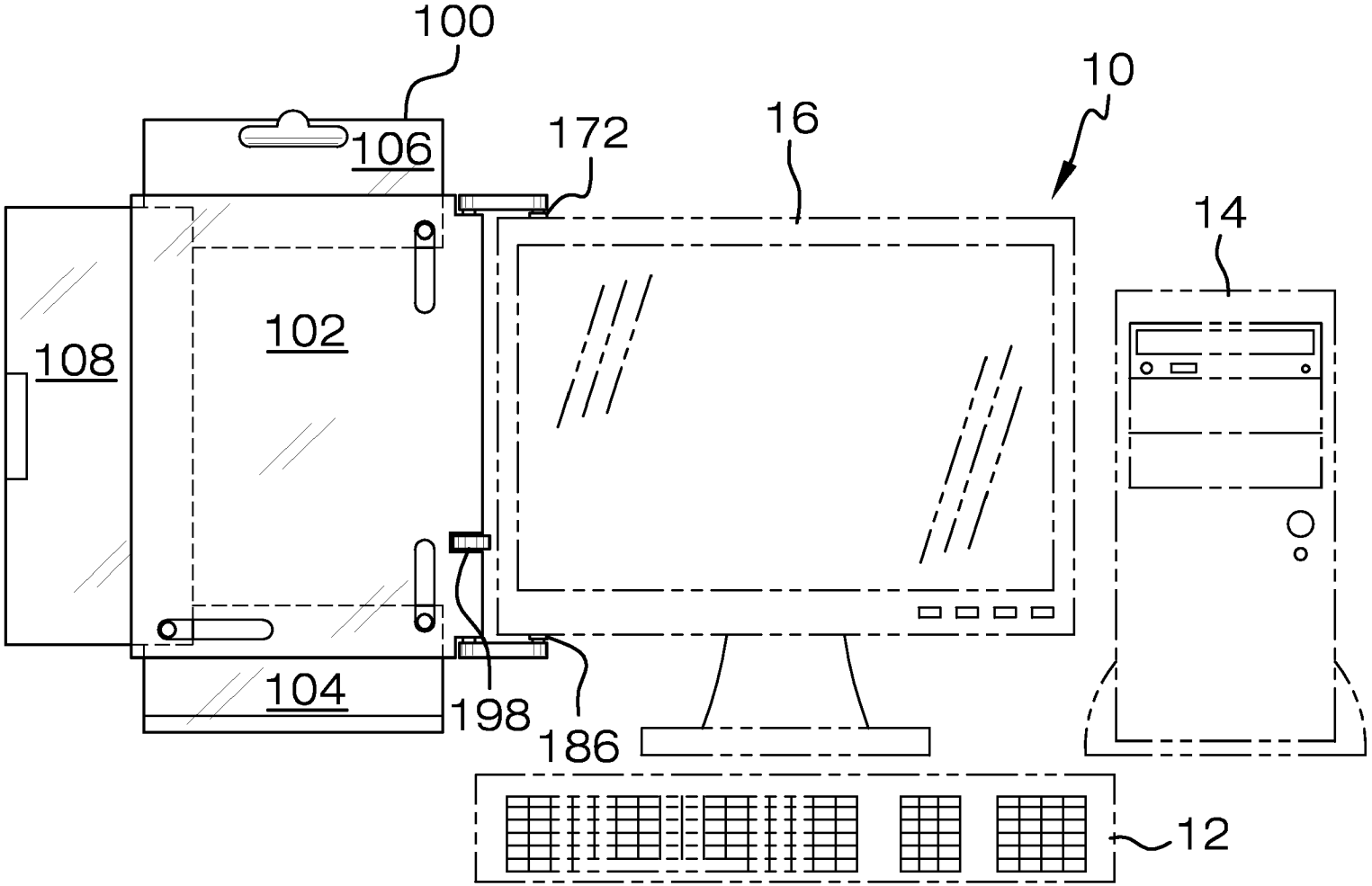
FIG. 1 is a front view of a document holder 100 attached to a computer 10.

FIG. 1 is a front view of a document holder 100 attached to a computer 10. Document holder 100 may be a moveable support to hold material in position to be viewed during use of computer 10. Computer 10 may be a device that may aid the act of transcribing and may include a keyboard 12, a hard drive 14, and a monitor 16. Document holder 100 may be configured to attach to monitor 16.

Figure 2:
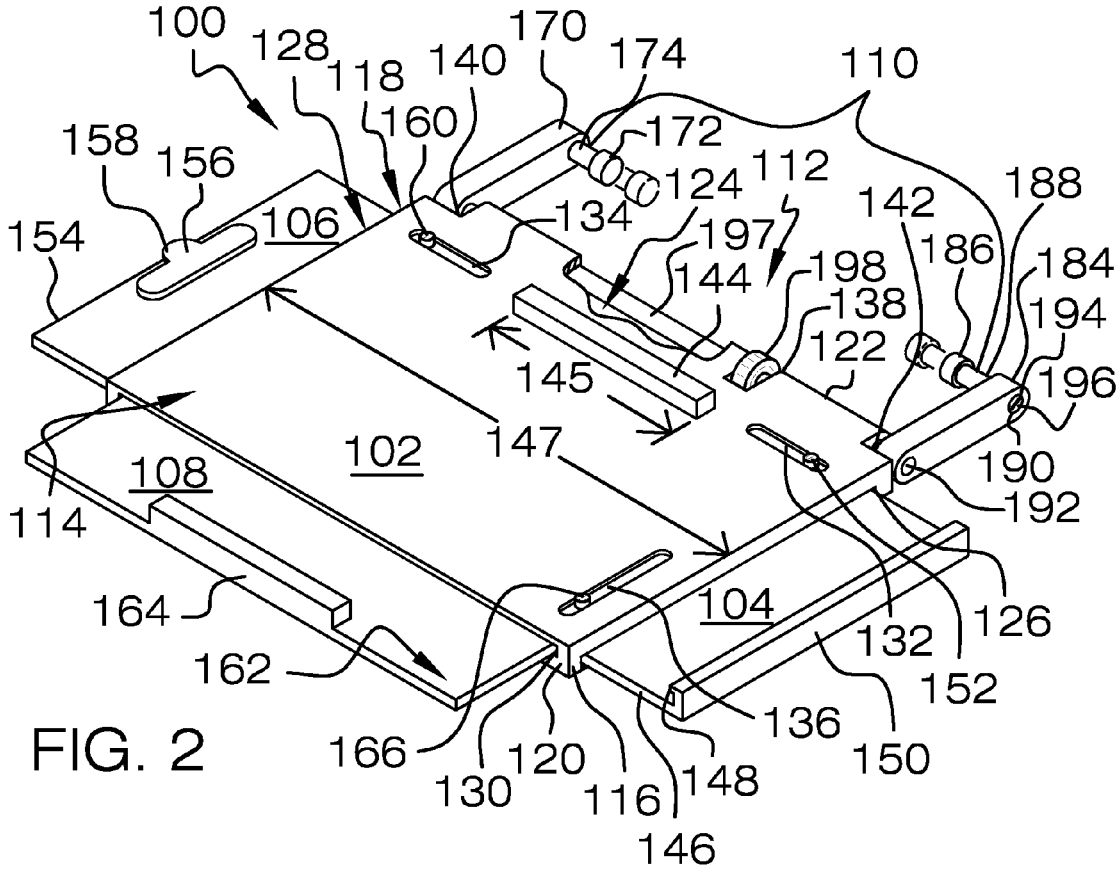
FIG. 2 is a first isometric view of document holder 100.

FIG. 2 is a first isometric view of document holder 100. Document holder 100 may include a panel 102, a bottom extension 104, a top extension 106, a left side extension 108, fasteners 110, and rotation mechanism 112. Each element may be connected to cooperate with one another in holding material in position to be viewed during use of computer 10.

Panel 102 may include a panel surface 114, a panel bottom 116, a panel top 118, a panel left side 120, and a panel right side 122. Panel 102 may include an internal panel cavity 124 into and out of which extensions 104, 106, and 108 may move. Panel 102 further may include a panel bottom opening 126 positioned in panel bottom 116, a panel top opening 128 positioned in panel top 118, a panel left side opening 130 positioned in panel left side 120, a bottom extension slot 132, a top extension slot 134, a left side extension slot 136, where each slot may be positioned in panel surface 114. Panel 102 also may include a notch 138, an upper cutout 140, and a lower cutout 142 positioned in panel right side 122.

Panel surface 114 may be a flat surface against which documents and other material may be supported. Panel 102 additionally may include a right side guide 144 positioned near panel right side 122 between bottom extension slot 132 and top extension slot 134. Right side guide 144 may extend between panel bottom 116 and panel top 118 and extend above panel surface 114 to aid in aligning documents and other material that may be supported by panel surface 114. In one example, a right side guide length 145 of right side guide 144 may be one-half a panel surface length 147 of panel surface 114. This may lessen an overall weight of document holder 100 and may still permit right side guide 144 to provide document alignment assistance.

Bottom extension 104 may be an article supporting portion that may move to support taller articles. Bottom extension 104 may include a bottom base 146, a bottom lip 148, and a bottom rim 150 connected between bottom base 146 and bottom lip 148 to form a U-shape channel. Articles may sit on top of bottom rim 150 and be retained in place between bottom base 146 and bottom lip 148.

Bottom extension 104 further may include a bottom knob 152. Bottom knob 152 may have a width and height similar to right side guide 144. Similar may mean substantially equal to. With bottom base 146 partially positioned through panel bottom opening 126 and into internal panel cavity 124, bottom knob 152 may be attached to bottom extension 104 through bottom extension slot 132. With bottom extension slot 132 oriented in a direction of right side guide length 145, bottom knob 152 may move in the direction of right side guide length 145. Sliding bottom knob 152 up or down may move bottom extension 104 up or down, respectively.

There may be a snug fit between bottom base 146 and panel bottom opening 126 to maintain bottom extension 104 in a desired position. A snug fit may be a close fit such that bottom base 146 may fit closely inside panel bottom opening 126 but still may move within panel bottom opening 126 with a little effort by a user of document holder 100. The snug fit may help to retain a relative position between bottom rim 150 and panel bottom 116 during use while an article resides against bottom rim 150.

Top extension 106 may be an article-supporting portion that may move to support taller articles. Top extension 106 may include a top base 154, a clip 156, and a clip fastener 158 to connect clip 156 to top base 154. Articles may rest against top base 154 and be retained in place by clip 156.

Top extension 106 further may include a top knob 160. Top knob 160 may have a width and height similar to right side guide 144 and similar to bottom knob 152. Top knob 160, right side guide 144, bottom knob 152 may cooperate together to aid in aligning documents and other material that may be supported by panel surface 114. In an alternate example, a height of top knob 160 and bottom knob 152 may be flush with, or below, or below panel surface 114 to allow for articles having additional width near top knob 160 and/or bottom knob 152.

With top base 154 partially positioned through panel top opening 128 and into internal panel cavity 124, top knob 160 may be attached to top extension 106 through top extension slot 134. With top extension slot 134 oriented in the direction of right side guide length 145, top knob 160 may move in the direction of right side guide length 145. Sliding top knob 160 up or down may move top extension 106 up or down, respectively.

There may be a snug fit between top base 154 and panel top opening 128 to maintain top extension 106 in a desired position. A snug fit may be a close fit such that top base 154 may fit closely inside panel top opening 128 but still may move within panel top opening 128 with a little effort by a user of document holder 100. The snug fit may help to retain a relative position between top extension 106 and panel top 118 during use while an article resides against bottom rim 150 or is secured by clip 156.

Left side extension 108 may be an article-supporting portion that may move to support wider articles. Left side extension 108 may include a left side base 162, a left side guide 164, and a left side knob 166. Articles may be supported by left side base 162 and be guided by left side guide 162. Left side knob 166 may have a height that may be flush with, or below, panel surface 114 to allow articles to rest flush against panel surface 114.

With left side base 162 partially positioned through panel left side opening 130 and into internal panel cavity 124, left side knob 166 may be attached to left side extension 108 through left side extension slot 136. With left side extension slot 136 oriented perpendicular to the direction of right side guide length 145, left side knob 166 may move in a direction perpendicular to right side guide length 145. Sliding left side knob 166 left or right may move left side extension 108 left or right, respectively.

There may be a snug fit between left side base 162 and panel left side opening 130 to maintain left side extension 108 in a desired position. A snug fit may be a close fit such that left side base 162 may fit closely in panel left side opening 130 but still may move within panel left side opening 130 with a little effort by a user of document holder 100. The snug fit may help to retain a relative position between left side extension 108 and panel left side 120 during use while left side guide 164 may guide an article.

Fasteners 110 of FIG. 2 may secure document holder 100 to monitor 16 (FIG. 1). Fasteners 110 may include a top arm 170, a top finger tip 172, and a top finger 174 connected between top arm 170 and top finger tip 172. Top arm 170 may include a top arm internally threaded hole 176 (hidden in figures) and a top arm through hole 178 (hidden in figures). Top finger tip 172 may be a rubber tip and top finger 174 may be threaded to fit within top arm internally threaded hole 176 and have a tool slot 180 (hidden in figures, but see tool slot 194) on a top finger end 182 (compare bottom finger end 196) to permit top finger 174 to be rotated and tightened or loosened by a tool, such as a screw driver.

Fasteners 110 may include a bottom arm 184, a bottom finger tip 186, and a bottom finger 188 connected between bottom arm 184 and bottom finger tip 186. Bottom arm 184 may include a bottom arm internally threaded hole 190 and a bottom arm through hole 192. Bottom finger tip 186 may be a rubber tip and bottom finger 188 may be threaded to fit within bottom arm internally threaded hole 190 and have a tool slot 194 on an end 196 to permit bottom finger 188 to be rotated and tightened or loosened by a tool, such as a screw driver.

Rotation mechanism 112 may include a rod 197 and a wheel 198. Wheel 198 may be positioned within notch 138 and connected to rod 197. Top arm 170 may be positioned in upper cutout 140 and attached to rod 197 and bottom arm 184 may be positioned in lower cutout 142 and attached to rod 197. Rod 197 may reside within internal panel cavity 124.

Figure 3:
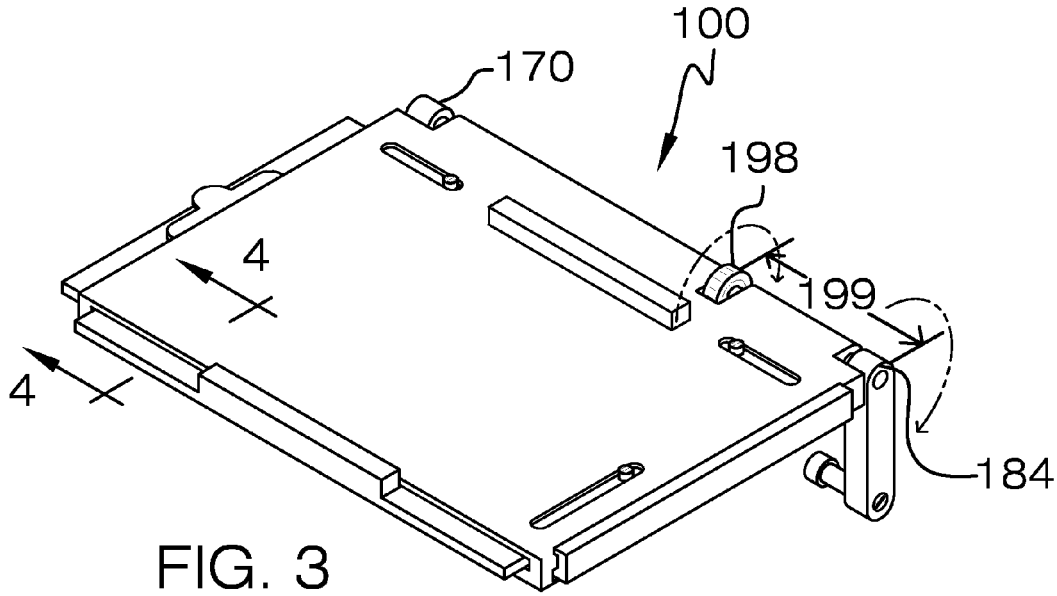
FIG. 3 is a second isometric view of document holder 100.

FIG. 3 is a second isometric view of document holder 100. As wheel 198 is rotated, that movement may be transmitted to rod 197 to rotate top arm 170 and bottom arm 184 in a same direction as wheel 198. In other words, document holder 100 may be swung back and forth by movement of wheel 198. Thus, when document holder 100 is not being used, document holder 100 may be swung back out of sight, flush against a side of monitor 16 (FIG. 1) while remaining connected to monitor 16. Alternately, document holder 100 may be slightly swung to optimize a viewing angle between a user and a document being supported by document holder 100. Wheel 198 may be attached to a right edge of panel 102 at a height 199 (FIG. 3) as measured from panel bottom 116, where height 199 may be about one quarter distance of panel surface length 147. Experiments have demonstrated that this one quarter distance is an optimal height and position for a user to access and manipulate wheel 198. Any higher or lower than this one quarter distance makes it difficult for a user to access and manipulate wheel 198.

Figure 4:
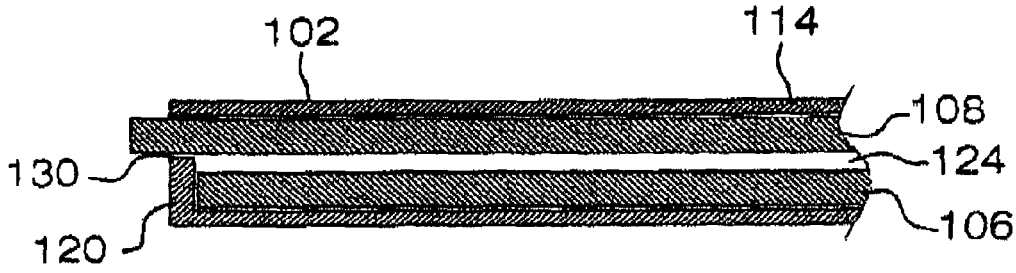
FIG. 4 is a section view of document holder 100 generally taken off of line 4-4 of FIG. 3.

FIG. 4 is a section view of document holder 100 generally taken off line 4-4 of FIG. 3. Bottom extension 104 (not shown in FIG. 4), top extension 106, and left side extension 108 may be stacked within internal panel cavity 124 to not interfere with one another. As in FIG. 4, a relative position between top extension 106 and left side extension 108 may be one where top extension 106 resides behind left side extension 108. Bottom extension 104 may reside behind left side extension 108 as well.

Figure 5:
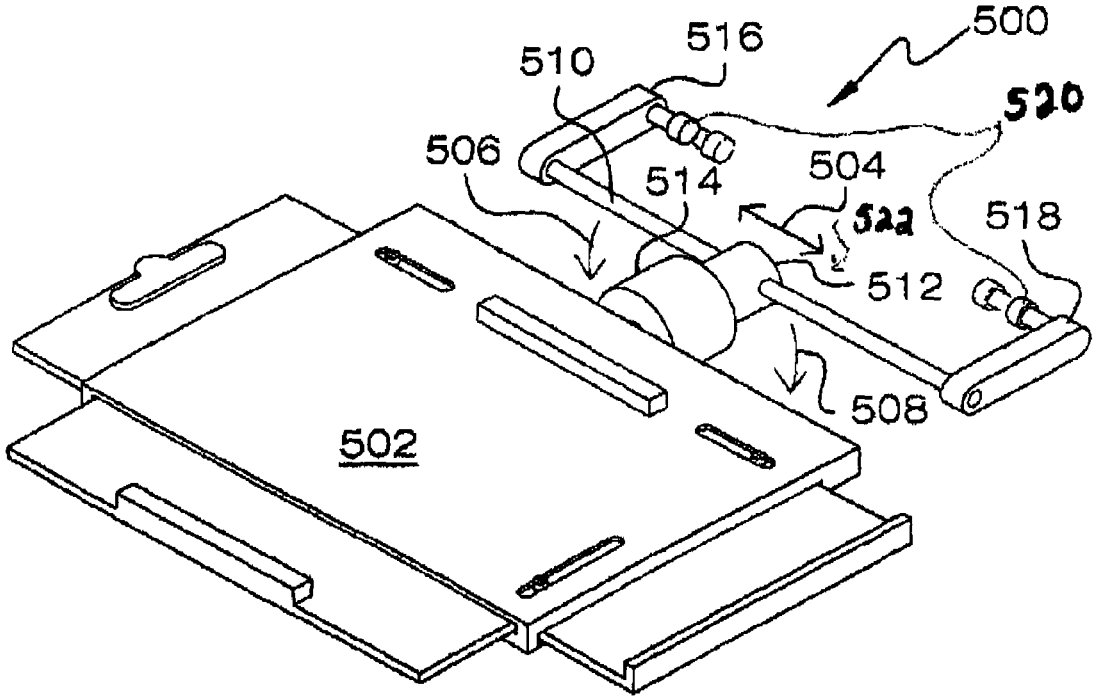
FIG. 5 is an isometric view of a document holder 500.

FIG. 5 is an isometric view of a document holder 500. Document holder 500 may permit a panel 502 to move up and down in a direction of arrow 504 and to pitch back and forth in a direction of arrow 506 and arrow 508. To achieve these motions, document holder 500 may include a rod 510 a slider 512 and a rotator 514, a top fastener 516 a bottom fastener 518, fasteners 520, and a rotating mechanism 522. Fastener 520 may include top fastener 516 and bottom fastener 518. Rotating mechanism 522 may be a panel movement mechanism that may include rod 510, slider 512 and rotator 514.

Rod 510 may be connected between top fastener 516 and bottom fastener 518. Slider 512 may be positioned about rod 510 and be moveably fixed to rod 510. For example, slider 512 may include a release button that may permit slider 512 to move relative to rod 510 when pressed and prevent slider 512 from moving relative to rod 510 when released Rotator 514 may be positioned between panel 502 and slider 512. Although fixed in position to panel 502, rotator 514 may be moveable fixed to slider 512. For example, a connection between rotator 514 and slider 512 may include a ball and detent system that permits rotator 514 may include a ball and a detent system that permits 514 and slider 512 to move relative to each other when a minimum torque pressure is applied to rotator 514 but otherwise may fix rotator 514 and slider 512 relative to each other.

The document holder may be an adjustable, moveable attachment to a personal computer (PC) monitor to hold an article such as a document. The document holder may be swung back and forth or extended or reduced in length or width. A panel having retractable extensions may be connected via swivel arms to both a top and a bottom of the monitor near a left edge of the monitor. A wheel may be attached to a right edge of the panel about one quarter of the way up from a bottom of the panel. The wheel may be mounted on a wheel holder vertical rod attached to a top and bottom of the panel.

A width extender (for wider documents) may be attached to an outside vertical portion of the panel. There may be two height extenders (for taller documents), one attached to a horizontal top of the panel and one attached to a horizontal bottom of the panel. The document holder may be made of plastic, may be flexible, and may be transparent.

The document holder may fulfill a need for a retractable, adjustable attachment that may hold documents for a PC. An appealing feature of the document holder may be its ease of use, convenience, comfort, adjustability, and efficiency. No longer will it be awkward to read a document while typing on a PC. Since the document holder is configured to be attached to the computer monitor, the document holder cannot be tipped over or slid out of position. The document holder also overcomes the problem uncomfortably with looking at pieces of paper lying flat on the top of the desk while typing on the keyboard and looking at the PC monitor.

The document holder may hold a document vertically next to a side of the PC monitor—making it easy to read. With a document made secure and stable by the document holder, a user may easily type, look at the monitor, and glance at the document without changing the position of the head of the user. The retraceable fastener arms of the document holder may be adjustable to fit any sized PC monitor. The document holder also may be fully adjustable to hold documents of a wide range of sizes. The horizontal width extender and the two vertical length extenders may be independently adjusted for a firm, tight fit. This extremely lightweight unit may be easily moved to any desired position.

The document holder may make it easy to copy a printed document onto the computer. In addition, it may be convenient for holding a document for reference while creating a new document on the keyboard. The document holder may help a user relax and assume a more natural position when referencing a document and typing into a computer. As a result, error rates and discomfort may be reduced.

The document holder may help a user keep documents positioned properly while the user is working from them. This may help the user avoid pain and save space on the desk of the user. As a screen-mounted document holder, the document holder may keep documents in the same vertical plane, and may extend to support more than a single sheet of paper.

The document holder may be configured to support an article in inclined position and may hold copy for transcription, function as an easel, and may hold sheet music in a reading position. The document holder may display charactered material in position to be viewed for, and during, device-transcription of the material. The document holder may include fasteners to attach the document holder to, or interengaging it with the device.

The document holder may be height-adjustable to allow a user to raise or lower documents for a more comfortable viewing position. As the light changes during the day, a document holder user may need to readjust the viewing angle to avoid glare. An adjustable viewing angle may permit a user reposition the documents to avoid glare. In a different example, the document holder may permit a user to adjust a viewing angle. The document holder may be configured to have a slightly backward fixed tilt or may include swivels on the arms to allow a user to adjust the tilt.

A light may be attached externally and/or internally to the document holder to illuminate articles held by the document holder. A fiber optic device and integrated circuit may be installed on a front of the document holder to increase the comfort of the user. In particular, a USB cable may be attached to the document holder to activate the lighting of articles held by the document holder. A button and other components may be added to the document holder to permit a user to automatically flip pages of articles held by the document holder.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A document holder for a computer monitor, the document holder comprising:

a panel having a panel surface, a panel bottom, a panel top, a panel left side top, a panel right side, an internal panel cavity positioned between the panel bottom and the pane top, a panel bottom opening positioned in the panel bottom, a panel top opening positioned in the panel top, a panel left side opening positioned in the left side, a bottom extension slot, a top extension slot, and left side extension slot, where each slot may be positioned in the panel surface and where the panel further may include in the panel right side a notch, an upper cutout, and a lower cutout, and the panel additionally may includes a right side guide positioned near the panel right side between the bottom extension slot and the extension slot; a bottom extension attached to the panel through the panel bottom opening, where the bottom extension includes a bottom base, a bottom lip, and a bottom rim connected between the bottom base and the bottom lop to form a U-shape channel, where the bottom base further includes a bottom knob attached the bottom base and extends such that the bottom knob extends through the bottom extension slot; a top extension attached to the panel through the panel top opening, where the top extension includes a top base, a clip, and a clip fastener connected between the clip and the top, a left side extension attached to the through the panel left side opening, where the left side extension include a left side base having a left guide and a left side knob attached to the left side base;

fastener attached to the panel, where the fastener include a top fastener having a top arm, a top finger tip, and top finger connected between the top arm and the top finger tip and where the fasteners include a bottom fastener having a bottom arm, a bottom finger tip and a bottom finger connected between the bottom arm and the bottom finger tip, and a rotation mechanism attached to the panel, where the rotation mechanism includes a rod and a wheel positioned within the notch and connected to the rod, where the rotation mechanism is configured to swing the panel about the top arm and the bottom arm.

2. The document holder of claim 1, where the right guide extends between the panel bottom and the panel top and extends above the panel surface.

3. The document holder of claim 1, where side guide length of the right side guide is one-half a panel surface length of the panel surface, where the top extension slot is oriented in a direction that is perpendicular to the right side guide length.

4. The document holder of claim 1, where the bottom knob has a width and a height substantially equal to a width and a height of the right side guide.

5. The document holder of claim 1, where the bottom extension slot is oriented in the direction of the right guide length.

6. The document holder of claim 1, where there is a snug fit between the bottom base and the panel bottom opening.

7. The document holder of claim 1, where the top extension further includes a top right side guide having a width and a height substantially equal to the width and height of the right side guide.

8. The document holder of claim 1, where the top extension further includes a top knob, where the top knob, the right side guide, and the bottom knob are configured to cooperate together to aid in aligning articles supported by the panel surface.

9. The document holder of claim 1, where the top extension further includes a top knob, where a height of the top knob and a height of the bottom knob each are one of flush with and below the panel surface.

10. The document holder of claim 1, where the left side knob has a height that is on flush with and below the panel surface.

11. The document holder of claim 1, where the top arm includes a top arm internally threaded hole and a top arm through hole, where the top finger tip is a rubber tip, and where the top finger is threaded to fit within the top arm internally threaded hole.

12. The document holder of claim 1, where the bottom arm included a bottom arm internally threaded hole and a bottom arm through hole, where the bottom finger tip is a rubber tip and the bottom finger includes a tool slot on an end of the bottom finger, where the tool slot is configured to permit the bottom finger to be rotated by a tool.

13. The document holder of claim 1, where the top arm is positioned in the upper cutout and attached to the rod and the bottom arm is positioned in the lower cutout and attached to the rod.

* * * * *